US009254897B2

(12) United States Patent
Andrieu et al.

(10) Patent No.: US 9,254,897 B2
(45) Date of Patent: Feb. 9, 2016

(54) HYDRODYNAMIC APPENDAGE SUCH AS A KEEL OR A CENTERBOARD, AND A METHOD OF FABRICATION

(71) Applicant: SAFRAN, Paris (FR)

(72) Inventors: Sandra Andrieu, Pau (FR); Jean-Michel De Monicault, Croisy Sur Eure (FR)

(73) Assignee: SAFRAN, Paris (FR)

( * ) Notice: Subject to any disclaimer, the term of this patent is extended or adjusted under 35 U.S.C. 154(b) by 387 days.

(21) Appl. No.: 13/648,766

(22) Filed: Oct. 10, 2012

(65) Prior Publication Data

US 2013/0092071 A1 Apr. 18, 2013

(30) Foreign Application Priority Data

Oct. 14, 2011 (FR) ..... 11 59337

(51) Int. Cl.
*B63B 41/00* (2006.01)

(52) U.S. Cl.
CPC ..... *B63B 41/00* (2013.01); *Y10T 29/49826* (2015.01)

(58) Field of Classification Search
CPC .... B29P 15/04; B63B 41/00; Y10T 29/49826
USPC ..... 29/889.1, 889, 889.7, 889.72, 889.6; 102/395, 529
See application file for complete search history.

(56) References Cited

U.S. PATENT DOCUMENTS 2,364,635 A 12/1944 Hasler
3,379,164 A 4/1968 Pillon
4,620,484 A * 11/1986 Livne ..... 102/395

FOREIGN PATENT DOCUMENTS

DE 34 38 518 A1 4/1986

OTHER PUBLICATIONS

French Search Report for FR 1159337 dated May 8, 2012.
French Written Opinion for FR 1159337 dated Oct. 14, 2011.

* cited by examiner

*Primary Examiner* — Richard Chang
(74) *Attorney, Agent, or Firm* — Sughrue Mion, PLLC

(57) ABSTRACT

A method of fabricating a hydrodynamic appendage for a ship, the method including the steps of: forming two metal half-shells having outside surfaces that form the flanks of a hydrodynamically-active portion of the appendage; forming a metal head including a mechanism for securing the appendage to the ship; and assembling together the half-shells and the head so that the head is sandwiched between the top ends of the two half-shells and closes a top portion of an internal volume defined by the half-shells. The half-shells are welded to the head so as to make the internal volume watertight.

14 Claims, 3 Drawing Sheets

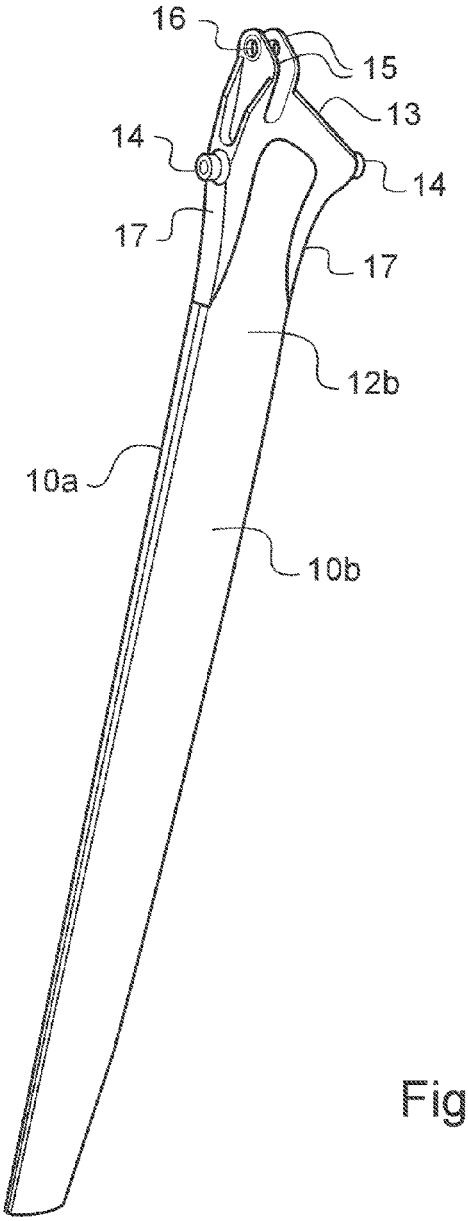
Fig.3
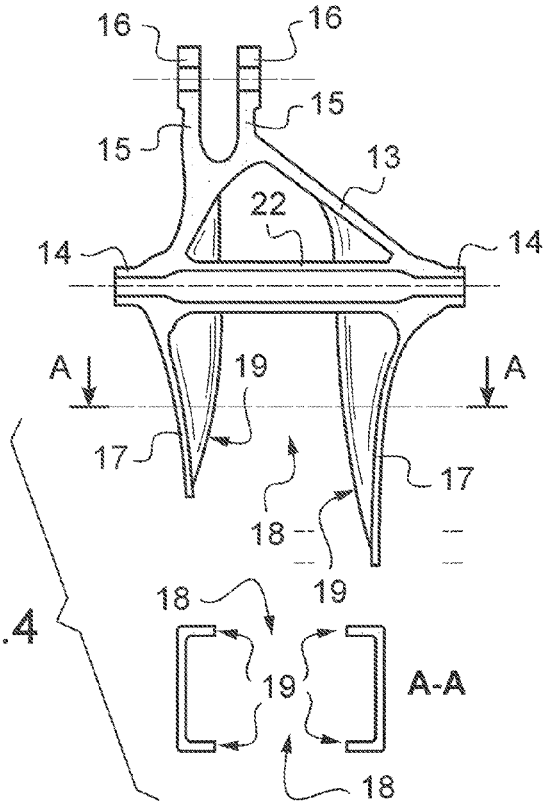
Fig.4
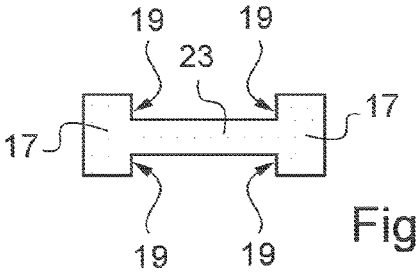
Fig.4bis

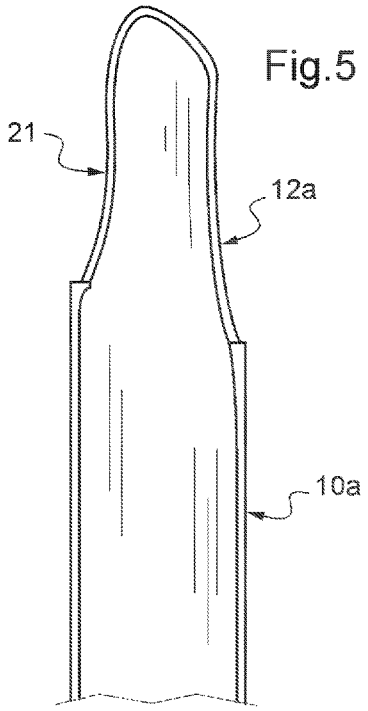
Fig.5
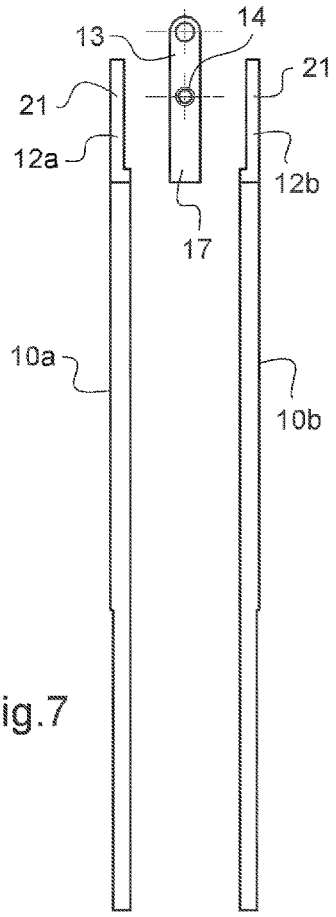
Fig.7
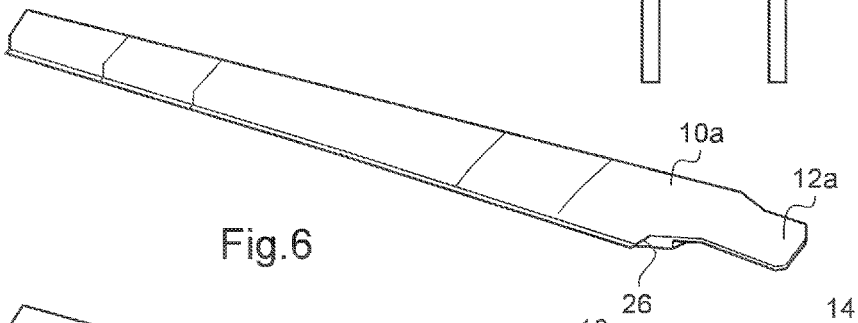
Fig.6
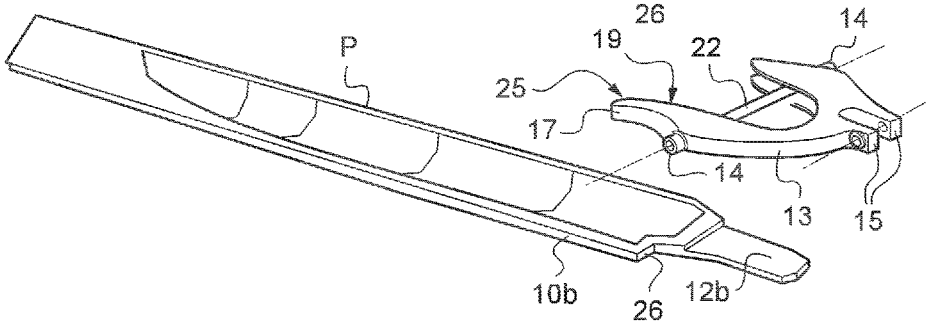

HYDRODYNAMIC APPENDAGE SUCH AS A KEEL OR A CENTERBOARD, AND A METHOD OF FABRICATION

The invention relates to a method of fabricating a hydrodynamic appendage for fitting to a ship so as to project from a hull thereof, like a keel fin, a centerboard, or a rudder blade.

BACKGROUND OF THE INVENTION

Such appendages include a hydrodynamically-active portion that may, under certain circumstances, be associated with various accessories, such as lift-providing foils that extend from the sides of the appendage, or indeed such as streamlined ballast attached to the end of the appendage, as for a keel fin.

Such appendages are traditionally made of steel. They need to combine great structural strength, in particular in lateral bending, while also supporting ballast that present considerable weight, at least for keel fins. Nevertheless, and in particular for keel fins, it is important to reduce the weight of the appendage as much as possible so that the center of gravity of the keel is as low as possible.

More recently, proposals have been made to make such appendages out of composite material, in particular comprising carbon fibers embedded in resin. Nevertheless, that type of fabrication raises various problems, in particular concerning the watertightness of the appendage and how it is to be connected to the hull.

OBJECT OF THE INVENTION

An object of the invention is to propose a method of fabricating a hydrodynamic appendage that is lightweight, watertight, and relatively simple to construct.

SUMMARY OF THE INVENTION

In order to achieve this object, the invention provides a method of fabricating a hydrodynamic appendage for a ship, the method comprising the steps of:

- forming two metal half-shells having outside surfaces that form the flanks of a hydrodynamically-active portion of the appendage;
- forming a metal head including means for securing the appendage to the ship; and
- assembling together the half-shells and the head so that the head is sandwiched between the top ends of the two half-shells and closes a top portion of an internal volume defined by the half-shells, the half-shells being welded to the head so as to make the internal volume watertight.

The connection made in this way between the top ends of the half-shells and the head ensures that the assembly is securely fitted together and suitable for transmitting bending forces efficiently from the appendage. Furthermore, closing the top portion of the internal volume of the appendage by means of the head simplifies ensuring that the assembly is watertight.

Preferably, the half-shells extend so as to make contact with each other along a join plane, and they are welded together in said join plane in the portion of the appendage that is hydrodynamically active. Thus, the appendage is made up of no more than the three above-mentioned main parts.

In a particular implementation, the head has flanks that present recesses for receiving the top ends of the half-shells so that the side edges of the top ends come into contact with complementary side edges of the recesses.

In a preferred implementation, the half-shells and the head are made of titanium alloy, preferably a high performance titanium alloy of the Ti10-2-3 family.

Titanium alloys present significant advantages in this type of application. In particular, they naturally present high resistance to cracking as a result of corrosion under stresses applied by sea water, because of the capacity of the passivating protective outer layer (mainly constituted of titanium oxide) to reform very quickly in the event of being scratched or suffering an impact. Furthermore, titanium alloys possess a ratio of strength/density that is particularly advantageous, thereby making it possible to make half-shells that are hollowed out and therefore light in weight while nevertheless being strong.

The invention also provides a hydrodynamic appendage for a ship, the appendage comprising:

- two metal half-shells having outside surfaces forming the flanks of a hydrodynamically-active portion of the appendage; and
- a metal head including means for securing the appendage to the ship;

the half-shells and the head being assembled together in such a manner that the head is sandwiched between the top ends of the two half-shells and in such a manner as to form an internal volume between the two half-shells, the assembly formed by the head sandwiched between the two half-shells being welded so as to make the internal volume of the appendage watertight.

The head sandwiched between the top ends of the half-shells may also be designed to close a top portion of the internal volume defined by the half-shells. This makes it possible to close the internal volume at the same time as assembling the head, thereby saving one operation.

The head may also include recesses defined by side edges that extend so as to come into contact with side edges at the top ends of the half-shells. This configuration provides a saving in weight by hollowing out the head while also reinforcing the strength of the assembly between the head and the half-shells.

BRIEF DESCRIPTION OF THE FIGURES

The invention can be better understood in the light of the following description of particular, non-limiting embodiments of the invention given with reference to the figures of the accompanying drawings, in which:

FIGS. 2 and 3 are perspective views of the FIG. 1 fin as seen from different angles;

FIG. 4 is a section view of the head of the fin of FIGS. 2 and 3, with arms of the head being shown in section;

FIG. 4*b* is a section of the arms in a variant embodiment of the head;

FIG. 5 is a fragmentary face view of one of the half-shells, showing its inside;

FIG. 6 is an exploded view of the hydrodynamic appendage of FIGS. 2 and 3, shown during its assembly; and FIG. 7 is an edge-on view of the appendage of the invention during assembly.

DETAILED DESCRIPTION OF THE INVENTION

Figure 1:
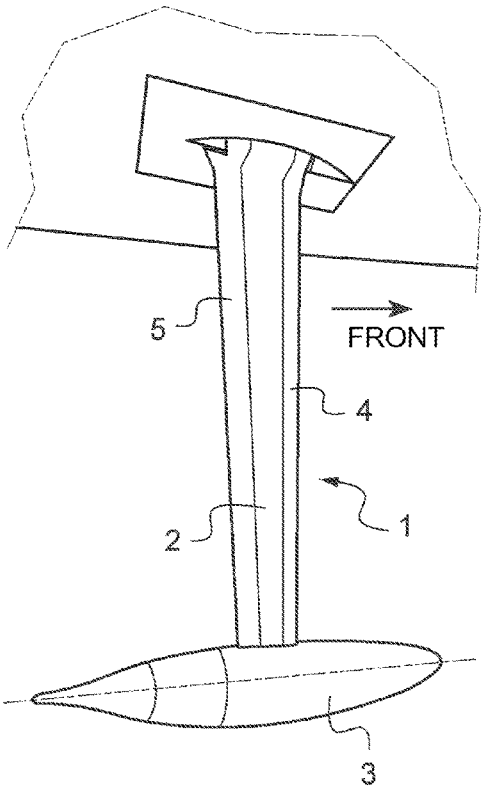
FIG. 1 is a perspective of a keel with a fin of the invention fitted with its ballast, shown in its position beneath the hull of a ship.

With reference to FIG. 1, the hydrodynamic appendage 1 of the invention in this example is a keel fin for receiving at its bottom end ballast 3 in the form of a bulb (drawn in dotted lines). The appendage 1 has a streamlined main portion 2 forming a hydrodynamically-active portion of the appendage that projects from the hull of the ship. At its top end the appendage has means for connection to the hull of the ship, specifically in this example stub axles enabling the appendage 1 to be hinged to a pivot that is secured to the hull so that the fin can be inclined, in particular as a function of the heeling of the ship.

In this example, the streamlined main portion 2 of the appendage 1 comprises a structural central portion made of titanium alloy, as described below, with a streamlined leading edge 4 and a streamlined trailing edge 5 fitted thereto.

Figure 2:
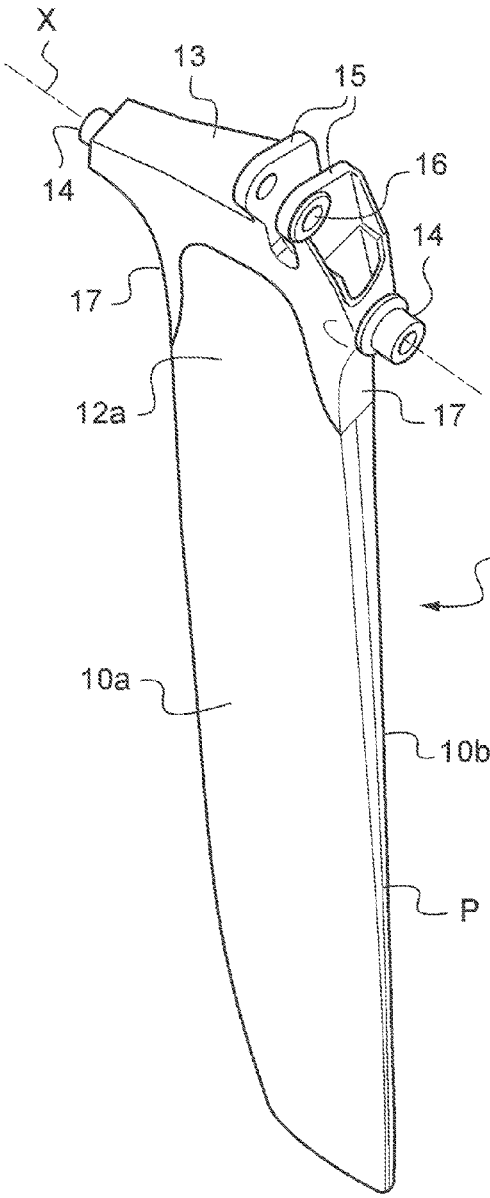

FIGS. 2 and 3 show the structural portion of the appendage 1 that is made of titanium alloy, the leading and trailing edges being omitted. It comprises two hollow half-shells 10*a* and 10*b* made of titanium alloy that are assembled together in a join plane P, the half-shells having top ends 12*a*, 12*b* that are clamped together by a head 13, also made of titanium alloy.

The head 13 is described below with reference in particular to FIG. 4. The head 13 carries stub axles 14 for hinging the appendage to the hull of the ship about a hinge axis X, and two plates 15 that extend perpendicularly to the axis X in order to define lugs 16 suitable for coupling the appendage to the end of an actuator for controlling movement of the appendage relative to the hull. The head 13 has two arms 17 that extend around the ends 12*a*, 12*b* of the half-shells. The two arms are connected together by a tie bar 22 made integrally with the remainder of the head 13 and joining together the stub axles 14.

The arms 17 of the head 13 define between them recesses 18 having side edges 19 that extend when the half-shells 10*a* and 10*b* are assembled to the head 13 so as to come into contact with matching side edges 21 of the top ends 12*a* and 12*b* of the half-shells. By juxtaposing FIGS. 4 and 5, it can be seen that the side edges 19 of the recesses in the head 13 and the side edges 21 at the top ends 12*a*, 12*b* of the half-shells are of exactly the same shape.

In a variant shown in FIG. 4*b* is, the arms 17 may be connected together by a web 23 that may be continuous or perforated, and on which the top ends 12*a*, 12*b* can rest when the half-shells are assembled to the head 13.

Assembly of the appendage 1 is shown in FIGS. 6 and 7. The half-shells 10*a* and 10*b* are moved together so as to touch each other in the join plane P, while inserting the head 13 between the top ends 12*a*, 12*b* of the half-shells so that the head 13 closes the top end of the inside volume defined by the half-shells. In these figures, it can be seen that the bottom ends 25 of the arms 17 of the head 13 fit against top edges 26 of the half-shells 10*a*, 10*b* forming the rear or the front of the structural portion of the appendage. The half-shells touch each other in the join plane P immediately after the ends of the arms 17.

The half-shells 10*a*, 10*b* and the head 13 are welded together along the bold lines visible in FIGS. 2 and 3, which correspond to the respective boundaries of said parts that are visible from the outside. Naturally, at the interface between the half-shells and the head, these definitions correspond to the facing side edges of the recesses in the head and the top ends of the half-shells.

The invention is naturally not limited to the above description, but on the contrary covers any variant coming within the ambit defined by the claims.

In particular, although, in the examples described, the half-shells extend so as to come into contact with each other along a join plane in the hydrodynamically-active portion of the appendage, the half-shells could be closed at the front or at the rear using a longitudinally extending member fitted between the half-shells and then welded to both half-shells in order to form a front face or a rear face of the appendage, thereby contributing to the structural strength and the watertightness of the appendage.

Although in this example the inside volume of the appendage is left empty or merely filled with gas (such as an inert gas), it could be filled with any filler material, such as polyurethane foam, or indeed it could receive stiffeners like ribs of an airplane wing.

For better understanding of the invention, it should be observed that:

- the term "hydrodynamically-active" portion of the appendage means a portion of the appendage that comes into contact with water once the appendage is plunged into the water and, during movement of the appendage in the water, that forms a sliding surface against the water;
- the term "top portion" of the inside volume is used to mean the portion of the inside volume that, when the hydrodynamic appendage is secured to the ship, is to be found closer to the ship than the bottom portion of the internal volume; and
- the "top" ends of the two half-shells mean the ends of the half-shells that are closest to the head, and thus to the means for securing to the ship.

The invention claimed is:

1. A method of fabricating a hydrodynamic appendage for a ship, the method comprising the steps of:

- forming two metal half-shells having outside surfaces that form flanks of a hydrodynamically-active portion of the appendage;
- forming a metal head including means for securing the appendage to the ship; and
- assembling together the half-shells and the head in such a manner that the head is sandwiched between top ends of the two half-shells and so as to form an internal volume between the two half-shells, the assembly formed by the head sandwiched between the two half-shells being welded together so as to make the internal volume of the appendage watertight, and the head including recesses defined by side edges that extend to come into contact with side edges of the top ends of the half-shells.

2. A method according to claim 1, wherein the head sandwiched between the top ends of the half-shells closes a top portion of the internal volume defined by the half-shells.

3. A method according to claim 1, wherein the half-shells and the head are made of titanium alloy.

4. A method according to claim 3, wherein the half-shells and the head are made of a titanium alloy of the 10-2-3 family.

5. A method according to claim 1, wherein the head carries stub axles for hinging the appendage to a hull of the ship.

6. A method according to claim 5, wherein the stub axles are connected together by a tie bar.

7. A method according to claim 6, wherein the head and the stub axles and the tie bar form a single part.

8. A method according to claim 1, wherein the head carries coupling members for coupling the head to an actuator for controlling movement of the appendage relative to the hull.

9. A hydrodynamic appendage for a ship, the appendage comprising:

- two metal half-shells having outside surfaces forming flanks of a hydrodynamically-active portion of the appendage; and
- a metal head including means for securing the appendage to the ship;
- the half-shells and the head being assembled together in such a manner that the head is sandwiched between top ends of the two half-shells and in such a manner as to form an internal volume between the two half-shells, the assembly formed by the head sandwiched between the two half-shells being welded so as to make the internal volume of the appendage watertight; and wherein the head includes recesses defined by side edges that extend to come into contact with side edges of the top ends of the half-shells.

10. A hydrodynamic appendage according to claim 9, wherein the head sandwiched between the top ends of the half-shells closes a top portion of the internal volume defined by the half-shells.

11. An appendage according to claim 9, wherein the half-shells and the head are made of titanium alloy.

12. A method of fabricating a hydrodynamic appendage for a ship, the method comprising the steps of:

forming two half-shells having outside surfaces that form flanks of a hydrodynamically-active portion of the appendage, each of the two half-shells having a length greater than a width so as to form an elongated shape extending from a bottom end to a top end of the half shell;

forming a head; and assembling together the two half-shells and the head wherein the head is sandwiched between the top ends of the two half-shells and to form an internal volume between the two half-shells, the assembly formed by the head sandwiched between the two half-shells welded together so as to make the internal volume of the appendage watertight, and wherein the head includes recesses defined by side edges that extend to come into contact with side edges of the top ends of the half-shells.

13. A method according to claim 12, wherein the two half-shells are made from a metal and the head is made from a metal.

14. A method according to claim 12, wherein the head is configured to secure the hydrodynamic appendage to the ship.

* * * * *